US009061514B2

(12) United States Patent
Frazier et al.

(10) Patent No.: US 9,061,514 B2
(45) Date of Patent: Jun. 23, 2015

(54) RELEASE AGENT APPLICATOR SYSTEM WITH REPLACEABLE RESERVOIR PAD

(71) Applicant: Xerox Corporation, Norwalk, CT (US)

(72) Inventors: Isaac S. Frazier, Portland, OR (US); Daniel C. Park, Woodinville, WA (US)

(73) Assignee: Xerox Corporation, Norwalk, CT (US)

( * ) Notice: Subject to any disclaimer, the term of this patent is extended or adjusted under 35 U.S.C. 154(b) by 218 days.

(21) Appl. No.: 13/688,637

(22) Filed: Nov. 29, 2012

(65) Prior Publication Data

US 2014/0146115 A1 May 29, 2014

(51) Int. Cl.

| | |
|---|---|
| ***B41J 2/175*** | (2006.01) |
| ***B41J 2/005*** | (2006.01) |
| *B41J 2/01* | (2006.01) |

(52) U.S. Cl.

CPC ..... *B41J 2/17593* (2013.01); *Y10T 29/49401* (2015.01); *B41J 2/175* (2013.01); *B41J 2/17566* (2013.01); *B41J 2002/012* (2013.01); *B41J 2/0057* (2013.01)

(58) Field of Classification Search

CPC ..... B41J 2/175; B41J 2/1752; B41J 2/17593; B41J 2/0057; B41J 2/1707; B41J 2/17566; B41J 2/16552; B41J 2/2114; B41J 2002/012; Y10T 29/49401

USPC ..... 347/85–88, 99, 103

See application file for complete search history.

(56) References Cited

U.S. PATENT DOCUMENTS

| | | | | |
|---|---|---|---|---|
| 5,047,809 | A | 9/1991 | Owada et al. | |
| 5,709,748 | A | 1/1998 | Sassa et al. | |
| 6,068,372 | A | 5/2000 | Rousseau et al. | |
| 6,263,182 | B1 | 7/2001 | Baker et al. | |
| 7,036,920 | B2 | 5/2006 | Rousseau et al. | |
| 7,393,312 | B2 | 7/2008 | Rousseau | |
| 7,699,459 | B2 | 4/2010 | Gault et al. | |
| 7,731,347 | B2 | 6/2010 | Gordon et al. | |
| 8,882,223 | B2 * | 11/2014 | Harris et al. | 347/14 |
| 2006/0285872 | A1 * | 12/2006 | Fukuta et al. | 399/99 |
| 2011/0149002 | A1 | 6/2011 | Kessler | |
| 2011/0194870 | A1 * | 8/2011 | Hase et al. | 399/69 |

* cited by examiner

*Primary Examiner* — Matthew Luu
*Assistant Examiner* — Rut Patel
(74) *Attorney, Agent, or Firm* — Maginot Moore & Beck LLP

(57) ABSTRACT

A release agent application system includes an image receiving member, a release agent applicator roller, a release agent pad, a release agent reservoir, and an actuator. The actuator operates the release agent applicator roller to move it between a resting position, where the roller absorbs release agent from the pad, and an application position, where the roller engages a surface of the image receiving member and to transfer release agent to the image receiving member.

14 Claims, 6 Drawing Sheets

RELEASE AGENT APPLICATOR SYSTEM WITH REPLACEABLE RESERVOIR PAD

TECHNICAL FIELD

The system described below relates to offset or indirect printing, and more particularly to an apparatus for applying release agent to a surface of an image receiving member in an offset inkjet printer.

BACKGROUND

The word "printer" as used herein encompasses any apparatus, such as a digital copier, book marking machine, facsimile machine, multi-function machine, etc., that produces an image with a colorant on recording media for any purpose. Printers that form an image on a surface of an image receiving member and then transfer the image to recording media are referenced in this document as indirect printers. Indirect printers typically use intermediate transfer, transfix, or transfuse members to facilitate the transfer and fusing of the image from the image receiving member to the recording media. In general, such printing systems typically include a colorant applicator, such as a printhead, that forms an image with colorant on the image receiving member. Recording medium is fed into a nip formed between the surface of the image receiving member and a transfix roller to enable the image to be transferred and fixed to the print medium so the image receiving member can be used for formation of another image.

In solid ink imaging systems having intermediate image receiving members, ink is loaded into the system in a solid form, either as pellets or as ink sticks, and transported through a feed chute by a feed mechanism for delivery to a heater assembly. A heater plate in the heater assembly melts the solid ink impinging on the plate into liquid ink that is delivered to a printhead for jetting onto a surface of an image receiving member. In the printhead, the liquid ink is typically maintained at a temperature that enables the ink to be ejected by the inkjet ejectors in the printhead, while preserving sufficient tackiness for the ink to adhere to the surface of the image receiving member. In some cases, however, the tackiness of the liquid ink can cause a portion of the ink to remain on the surface of the image receiving member after the image is transferred onto the media sheet. This remnant of the jetted image can later degrade other images formed on the surface of the image receiving member.

Solid inkjet imaging systems generally use electronic image data to generate firing signals for the ejection of melted ink to produce the ink image. In indirect solid inkjet imaging systems, like printer 300 shown in FIG. 5, the electronic image data are used to eject ink onto the surface of an intermediate image receiving member 304. A media sheet 308 is then brought into contact with the image receiving member 304 in a nip 312 formed between the image receiving member 304 and a transfer roller 316. The heat and pressure in the nip 312 helps transfer the ink image from the image receiving member 304 to the media sheet 308.

One issue arising from the transfer of an ink image from an image receiving member 304 to a media sheet 308 is the build-up of ink on the image receiving member 304. Build-up of ink on the image receiving member 304 can cause various image defects because ink that remains on the image receiving member 304 from a previous print can be unintentionally transferred to the media sheet 308 in a subsequent print.

Accordingly, reducing the build-up of ink on the image receiving member 304 improves the efficacy of the printer and the quality of the prints.

To address the build-up for ink on the image receiving member 304, release agent is applied to the image receiving member 304 in a thin layer prior to the application of ink to the image receiving member 304. The release agent is a substance which prevents the ink from adhering directly to the image receiving member 304, facilitating the proper transfer of the ink from the image receiving member 304 to the media sheet 308 when the media sheet 308 passes through the nip 312. Release agent is typically applied to an image receiving member 304 at levels greater than 10 mg/sheet, and various release agent applicators 320 have been designed to properly apply the correct amount of release agent to the image receiving member 304.

One way that release agent is applied to an image receiving member in the amounts noted above is with a release agent roller as shown in FIG. 6. In this embodiment, the printer 2 includes a pivot shaft 4 permanently mounted within the printer 2 and a pivot arm 8 permanently mounted to the pivot shaft 4. The pivot arm 8 rotates about the pivot shaft 4. In this embodiment, the release agent roller 12 is a foam roller formed from an absorbent material that is saturated with release agent. The release agent roller 12 is saturated with a supply of release agent to be used for the life of the release agent roller 12. The release agent roller 12 is provided within a tray 20. The tray 20 is coupled to the pivot arm 8 and rotates around the pivot shaft 4 to move the release agent roller 12 in and out of contact with the image receiving member 28. The release agent roller 12 and the tray 20 are coupled together as a single unit. Together, the release agent roller 12 and the tray 20 are removed from the printer to be replaced by a new tray 20 having a new release agent roller 12 that is fully saturated with release agent to replenish the supply of release agent. For removal and replacement, the tray 20 is configured to slide into and out of connection with the pivot arm 8 in a direction aligned with the pivot shaft 4, but does not slide along the pivot shaft 4.

A wiping blade 32 is also mounted to the pivot shaft 4 to rotate around the pivot shaft 4. In this embodiment, the wiping blade 32 is permanently mounted within the printer 2 and is positioned within the tray 20. The wiping blade 32 is not replaced with the tray 20 and the release agent roller 12. The wiping blade 32 rotates into and out of contact with the image receiving member 28 to wipe excess release agent from a surface 36 of the image receiving member 28. Excess release agent is collected in the bottom of the tray 20 to be absorbed by a thin foam pad 16. The foam pad 16 presses against the release agent roller 12 with enough pressure to return excess release agent to the release agent roller 12, but not with enough pressure to prevent the release agent roller 12 from rolling in contact with the image receiving member. A filter 40 is located between the foam pad 16 and the release agent roller 12 and removes particulates from the excess release agent before the release agent is reabsorbed by the release agent roller 12.

To apply release agent to the surface 36 of the image receiving member 28, the entire tray 20 is rotated to move the release agent roller 12 toward the image receiving member 28 until the release agent roller 12 contacts the surface 36 of the image receiving member 28. The release agent roller 12 then applies release agent to the surface 36 of the image receiving member 28, the metering blade 32 removes excess release agent from the surface 36 of the image receiving member 28 and deposits it in the tray 20. Once the release agent has been applied to the surface 36 of the image receiving member 28, the tray 20 moves away from the image receiving member 28 to move the release agent roller 12 out of contact with the image receiving member surface 36 to prevent interference with the imaging process and disturbance of the image that is laid down over the layer of release agent on the image receiving member 28.

While this release agent roller system provides release agent to the image receiving member 28 in an effective amount, it also suffers from some limitations. One limitation arises from the supply of release agent being contained within the system. Once the supply of release agent is exhausted, the printer needs to be serviced and either the release agent roller 12 or the entire tray 20 removed and replaced. Additionally, because all of the release agent used in the release agent roller system is contained within the tray 20 or the release agent roller 12, which is also provided within the tray 20, the tray 20 is heavy. Thus, moving the tray 20, including the release agent roller 12 toward and away from the image receiving member 28 also involves moving a large, and heavy, supply of release agent requiring a more powerful actuator and more energy.

As described above, applying release agent to the surface of an image receiving member with a release agent applicator is effective at preventing the presence of unwanted ink on the image receiving member. Additionally, using release agent reduces the need for maintenance. Also, supplying the release agent to the image receiving member in an efficient manner reduces the energy needs of the printer. Accordingly, providing a release agent application system which enables efficient use of release agent and enables proper application of release agent on the image receiving member while requiring little energy to apply the release agent to the image receiving member is a desirable goal. Reducing the amount of energy required to apply release agent to the image receiving member, in turn, enables reduction in size, cost, and noise associated with the application of release agent. Reducing the amount of waste generated over the lifetime of a printer that uses a release agent application is also desirable.

SUMMARY

A release agent application system for use in a solid ink printer has been developed. The release agent application system includes an image receiving member, a pad, a roller, and an actuator. The pad stores a supply of release agent. The roller absorbs release agent from the pad in response to being in contact with the pad. The actuator is connected to the roller and moves the roller between a first position and a second position. In the first position, the roller contacts the pad, and in the second position, the roller contacts the image receiving member.

A method of servicing a printer to perform maintenance on a release agent application system has been developed. The method includes positioning a release agent applicator roller in a position to make a pad accessible, removing the pad from the printer, and installing a new pad having a new supply of release agent in the printer.

A solid ink printer including a release agent application system has been developed. The printer includes an image receiving member and a release agent applicator system. The release agent applicator system applies release agent to a surface of the image receiving member. The release agent applicator system includes a pad, a roller, an actuator, and a printhead. The pad stores a supply of release agent. The roller absorbs release agent from the pad in response to being in contact with the pad. The actuator is connected to the roller and moves the roller between a first position and a second position. In the first position, the roller contacts the pad, and in the second position, the roller contacts the image receiving member. The printhead applies ink onto the release agent on the surface of the image receiving member.

DETAILED DESCRIPTION

Figure 1:
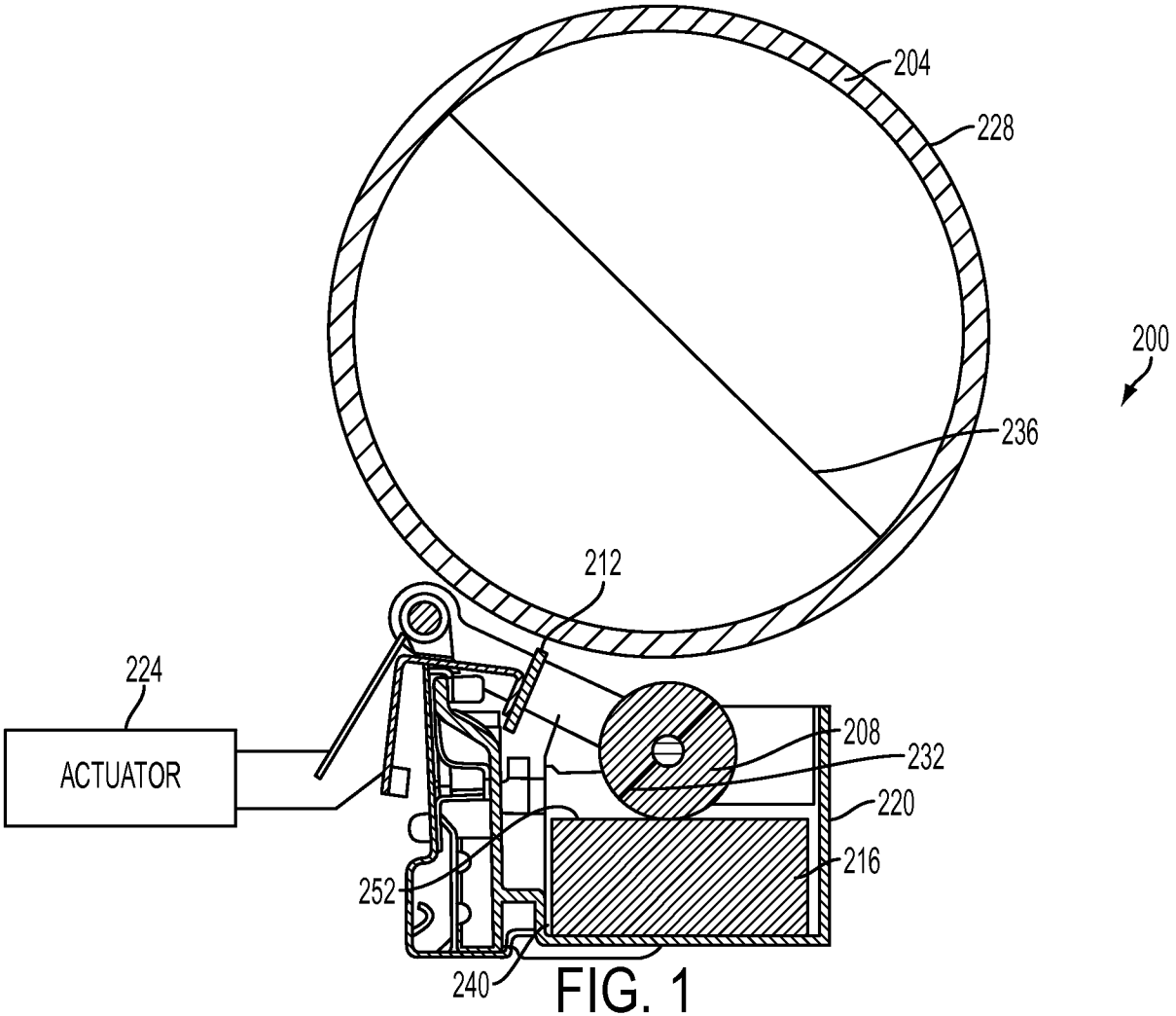
FIG. 1 depicts a release agent application system having an image receiving member, a release agent pad, and a release agent applicator roller in a resting position to be used in an indirect printer.
Figure 2:
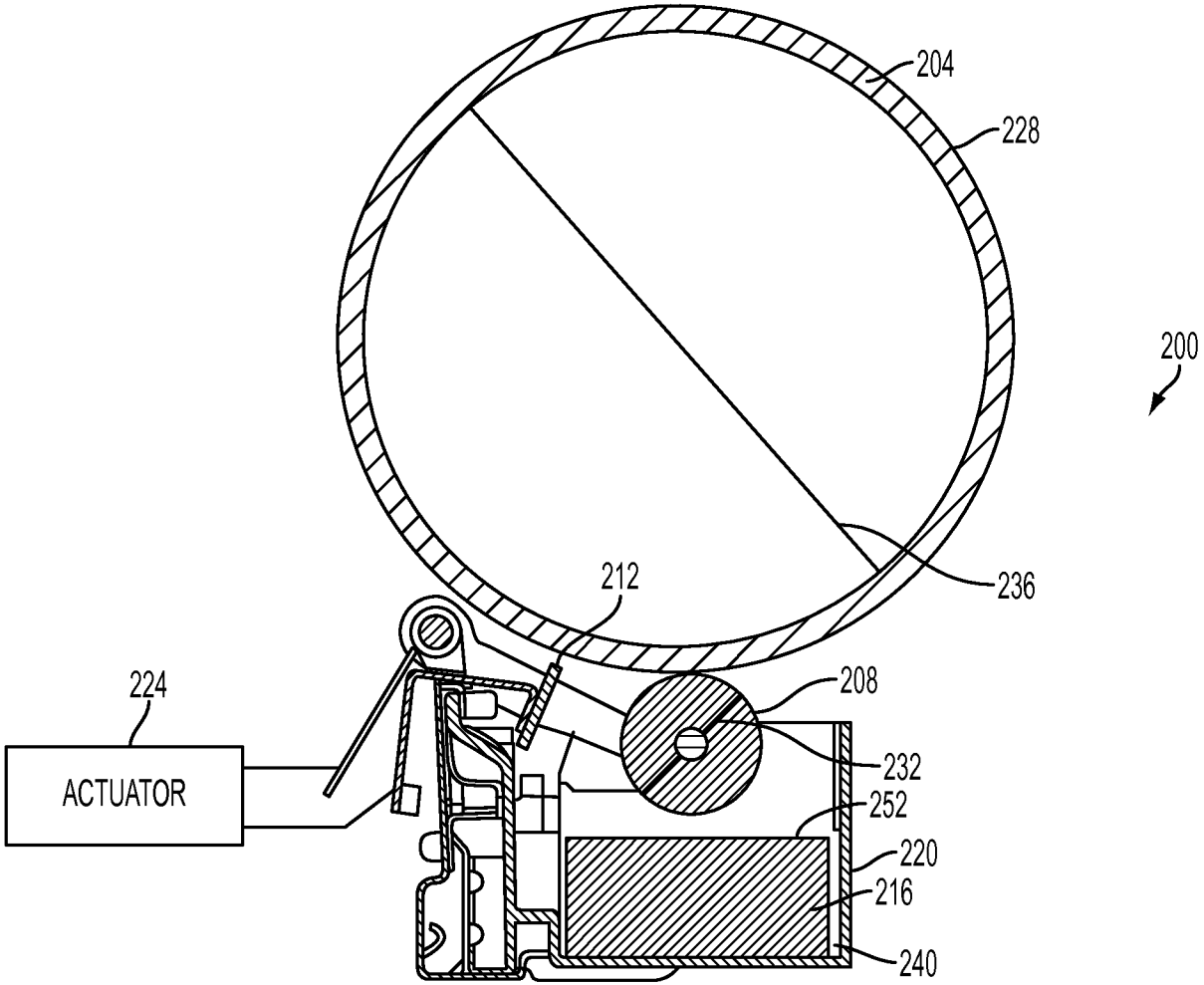
FIG. 2 depicts the release agent application system of FIG. 1 with the release agent applicator roller in an application position.

The release agent application system 200 shown in FIG. 1 and FIG. 2 includes an image receiving member 204, a release agent applicator roller 208, a metering blade 212, a release agent pad 216, a release agent tray 220, and an actuator 224. The actuator 224 is operatively connected to the release agent applicator roller 208 to move the release agent applicator roller 208 between a resting position (shown in FIG. 1), in which it rests on the release agent pad 216 and absorbs release agent therefrom, and an application position (shown in FIG. 2), in which it engages the surface 228 of the image receiving member 204 and applies release agent thereto.

The release agent applicator roller 208 is sized such that it applies release agent along the entire length of the image receiving member 204. If, for example, the image receiving member 204 is approximately 11 inches long, the release agent applicator roller 208 will also be approximately 11 inches long. The release agent applicator roller 208 has a release agent applicator roller diameter 232 that is smaller than an image receiving member diameter 236. The release agent applicator roller diameter 232 can be relatively small because the release agent applicator roller 208 remains in a fixed position while it rotates to apply an even coat of release agent as the surface 228 of the image receiving member 204 rotates past it. The release agent applicator roller diameter 232 can be, for example, approximately one fifth of the image receiving member diameter 236.

The release agent applicator roller 208 is cylindrically shaped and is made of a foam material that allows release agent to saturate the entire volume of the release agent applicator roller 208. Additionally, the properties of the foam enable the release agent to saturate the release agent applicator roller 208 substantially uniformly, regardless of the orientation of the release agent applicator roller 208, through capillary action. The release agent applicator roller 208 is constructed out of, for example, polyurethane foam or another material having similar properties.

The metering blade 212 is a flexible wiping blade configured to move into and out of engagement with the image receiving member 204. When in engagement with the image receiving member 204, the metering blade 212 is positioned proximate to and downstream of the release agent applicator roller 208 on the surface 228 of the image receiving member 204. In other words, as the image receiving member 204 rotates, surface 228 engages the release agent applicator roller 208 prior to engaging the metering blade 212.

The actuator 224 is operatively connected to the metering blade 212 to move the metering blade 212 in conjunction with the release agent applicator roller 208 via independent cams. In other words, the metering blade 212 and the release agent applicator roller 208 are attached to the same shaft, and are moved by different cams on the same shaft such that both the metering blade 212 and the release agent applicator roller 208 are moved by the same motor. In this embodiment, the cams that move the metering blade 212 and the release agent applicator roller 208 are arranged on the shaft such that the metering blade 212 and the release agent applicator roller 208 are actuated sequentially. In other embodiments, however, the cams can be arranged to actuate the metering blade 212 and the release agent roller applicator 208 simultaneously, non-sequentially, or independently. In another alternative embodiment, the actuator 224 can be replaced with two separate actuators to operate the release agent applicator roller 208 and the metering blade 212 independently.

In this embodiment, the actuator 224 first moves the metering blade 212 into engagement with the image receiving member 204 and then moves the release agent applicator roller 208 into engagement with the image receiving member 204. When the metering blade 212 and the release agent applicator roller 208 are engaged with the image receiving member 204, they are in position to apply release agent to the image receiving member. After the release agent applicator roller 208 has applied release agent to the image receiving member 204, the actuator first moves the release agent applicator roller 208 to disengage the image receiving member 204 while the image receiving member 204 continues to rotate. After the metering blade 212 has engaged the entire circumference of the image receiving member 204 to remove all excess release agent, the actuator 224 moves the metering blade 212 to disengage the image receiving member 204. When the metering blade 212 and the release agent applicator roller 208 are disengaged from the image receiving member 204, they are in a resting position.

When the metering blade 212 is in engagement with the image receiving member 204 it applies just enough pressure to the surface 228 of the image receiving member 204 to remove excess release agent applied thereto by the release agent applicator roller 208. The length of the metering blade 212 is approximately equivalent to the length of the image receiving member 204 to ensure removal of excess release agent along the entire length thereof. The metering blade 212 is arranged such that the excess release agent that it removes drips down into the release agent tray 220. This arrangement is advantageous because it promotes application of the correct amount of release agent to the image receiving member 204 while preventing unnecessary waste. The release agent applicator roller 208 applies more release agent than required for forming the ink image on the image receiving member 204 to ensure that the surface 228 is adequately coated. Then, the metering blade 212 removes the excess, leaving only the required amount, and recycles the excess release agent by returning it to the release agent tray 220.

The release agent tray 220 is in the form of a trough configured to collect and retain release agent, including the excess release agent metered from the surface 228 of the image receiving member 204 by the metering blade 212. The release agent tray 220 contains the release agent pad 216, which is positioned on the bottom 240 of the release agent tray 220 to ensure the release agent pad 216 can absorb the collected release agent. The release agent pad 216 is further positioned below the release agent applicator roller 208 and provides a flat, stationary surface to support the release agent applicator roller 208 in the resting position.

The shape of the release agent pad 216 in one embodiment is substantially rectangular and is sized to contact the entire length of the release agent applicator roller 208. The size of the release agent pad 216 limits the amount of release agent that it can store and readily transfer to the release agent applicator roller 208 through contact with the roller. Because the release agent is transferred via surface contact, a portion of the release agent stored in the release agent pad 216 is not transferable to the release agent applicator roller 208. The reader should understand that the size of the release agent pad 216 depends on the requirements of the printer. In one embodiment, the release agent pad 216 is large enough to cover the bottom surface of the release agent applicator roller 208 in the resting position. In another larger embodiment, the release agent pad 216 covers the entire bottom surface 240 of the release agent tray 220. In one embodiment, the release agent pad 216 is configured to hold approximately 220 g of release agent. In another embodiment, the release agent pad 216 is configured to hold approximately 440 g of release agent.

In the embodiments just described, the release agent pad 216 is made of the same foam material as the release agent applicator roller 208 to facilitate absorption of the release agent from the release agent pad 216 to the release agent applicator roller 208 by capillary action. Additionally, the properties of the foam enable the release agent to saturate the release agent pad 216 substantially uniformly through capillary action enabling the release agent pad 216 to absorb release agent from the bottom 240 of the release agent tray 220 and deliver it to the release agent applicator roller 208 through a top surface 252 of the release agent pad 216.

Additionally, the properties of the foam enable the release agent pad 216 to function as a filter for the release agent to be supplied to the release agent applicator roller 208. The release agent that is metered off the image receiving member 204 by the metering blade 212 and returned to the release agent tray 220 can pick up impurities. For example, before being metered off the image receiving member 204, release agent can pick up portions of ink pixels that were not completely transferred from the image receiving member 204 during previous prints. The release agent pad 216 is configured with pores having a size adequate to remove these impurities before supplying the metered release agent to the release agent applicator roller 208. In one embodiment, the pores have diameters of approximately 20 to 70 microns.

In alternative embodiments, the release agent pad 216 need not be made of the same foam material as the release agent applicator roller 208, but such construction does facilitate absorption of the release agent from the release agent pad 216 to the release agent applicator roller 208 by capillary action. The release agent pad 216 can be made of any material which effectively absorbs, filters, and stores release agent and efficiently transfers release agent to the release agent applicator roller 208 through contact with the roller. Alternative materials for the release agent pad 216 and/or the release agent applicator roller 208 include, but are not limited to: non-polyurethane base foam (foam made from an alternate polymeric material); non-woven fiber material having fibers held together via matting or pressing; and stacked layers of woven fiber material.

The release agent application system 200 described above is advantageous because it utilizes a release agent applicator roller 208 having a low mass to apply release agent to the image receiving member 204, reducing build-up of ink on the image receiving member 204 and, thus, reducing image defects on subsequent prints. The release agent applicator roller 208 can be smaller as long as the roller stores enough release agent within the foam cylinder roller for an adequate covering of the image receiving member without requiring the roller to maintain a release agent supply sufficient for the operational life of the printer. Instead, the operational supply of release agent is maintained in the stationary release agent pad 216, which replenishes the roller 208 as needed.

As mentioned above, previous systems were configured such that the supply of release agent was contained within the roller and the actuator moved both the roller and the tray into and out of engagement with the image receiving member. Had such a system been configured to contain enough release agent to last for the usable life of the printer, the resulting size and weight of the system would have caused disadvantages in the production and operation of the printer. Thus, these systems included consumable rollers and trays intended to be replaced multiple times over the life of the printer and containing approximately 150 g of usable release agent.

In the system 200, however, only the release agent applicator roller 208 is moved and the amount of release agent stored within the stationary release agent pad 216 can be as much as approximately 800 g of usable release agent. These features are advantageous because the release agent pad 216 of the system 200 can contain enough release agent to last for the usable life of the printer, and need not be replaced, or can be replaced as needed. Furthermore, the low mass of the release agent applicator roller 208 enables the actuator 224 to use less energy to move the release agent applicator roller 208 into and out of engagement with the image receiving member 204, reducing the energy consumption of the printer. Thus, a smaller, less expensive actuator 224 is able to be used with the system 200, and the actuator components are likewise able to be smaller and less expensive. Additionally, because the actuator 224 moves a smaller mass and fewer components, the system 200 generates less noise than previously known systems.

An additional advantage of the release agent application system 200 is the ease of replenishing the supply of release agent and the reduction of parts requiring replacement. Because the release agent is stored within the release agent pad 216 in the release agent tray 220, when the release agent application system 200 has exhausted its supply of release agent, only the release agent pad 216 needs to be replaced. The release agent applicator roller 208 need not be replaced, but remains inside the printer. Replacement of the release agent pad 216 is accomplished by operating the actuator 224 to move the release agent applicator roller 208 out of the resting position to provide access to the release agent pad 216. Next, the release agent tray 220 is removed from the printer, the exhausted release agent pad 216 is removed from the release agent tray 220, and a new pad having a new supply of release agent is installed within the release agent tray 220. Another advantage of the release agent application system 200 is that the release agent supply may not have to be replenished over the lifetime of the printer. Because the release agent is stored within the release agent pad 216, a large release agent pad 216 may contain enough release agent for the operational life of the printer.

Figure 3:
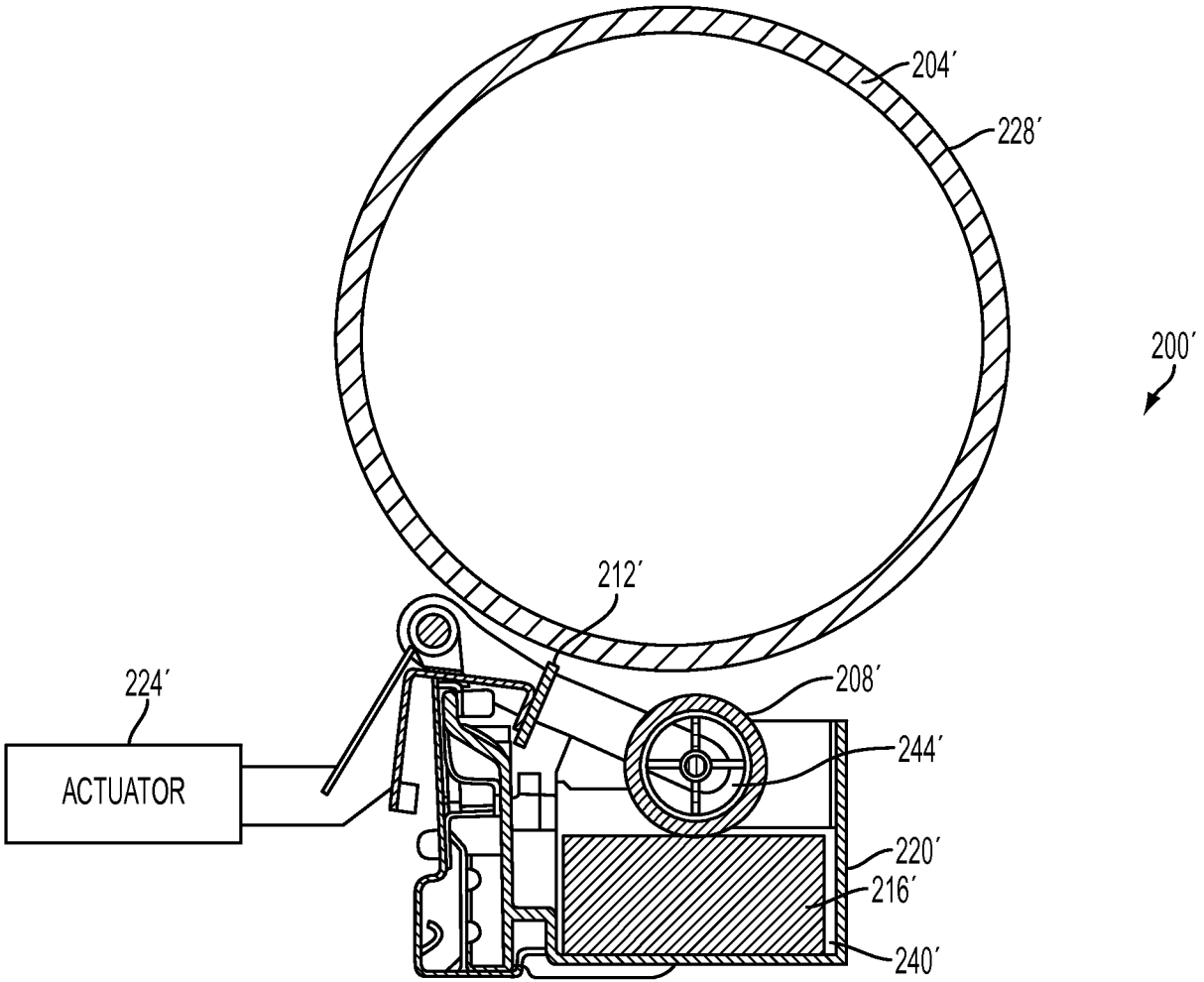
FIG. 3 depicts an alternative release agent application system having a release agent applicator roller with a hollow core.

In an alternative embodiment, shown in FIG. 3, release agent application system 200" includes a release agent applicator roller 208'. The release agent application system 200' is arranged and operated in substantially the same way as release agent application system 200 described above and shown in FIG. 1 and FIG. 2. Release agent application system 200' differs from release agent application system 200 because the release agent applicator roller 208' is configured as a substantially hollow cylindrical tube surrounding an open space 244'. The configuration of the release agent applicator roller 208' allows the diameter of the release agent application roller 208' to be larger than that of release agent application roller 208 without increasing the mass of release agent applicator roller 208'.

The release agent applicator roller 208' provides many of the same advantages to the release agent application system 200' as described above. Because the release agent applicator roller 208' is hollow, the roller maintains a low mass despite having a larger diameter than the release agent applicator roller 208'. In an alternative embodiment, the release agent applicator roller 208' need not be substantially hollow and can have a greater mass corresponding to the larger diameter. The larger diameter of the release agent applicator roller 208' enables a larger portion of the surface 228' of the image receiving member 204' to be contacted during application of release agent so a greater area of the member 204' is covered during the revolution of the roller 208' than is the area covered by a single revolution of the roller 208. One advantage of the increased diameter is that the increased contact between the release agent applicator roller 208' and the surface 228' of the image receiving member 204' enables a slower rotation of the roller 208' for a given rotation speed of the image receiving member 204'.

In one embodiment, the release agent pad 216' for the release agent application system 200' is larger to accommodate the larger release agent applicator roller 208'. While a larger release agent pad 216' requires more space within the printer, the larger pad is replaced less frequently than release agent pad 216, if at all. In an alternative embodiment, the release agent pad 216' need not be larger, but is still configured to accommodate the release agent applicator roller 208'.

Figure 4:
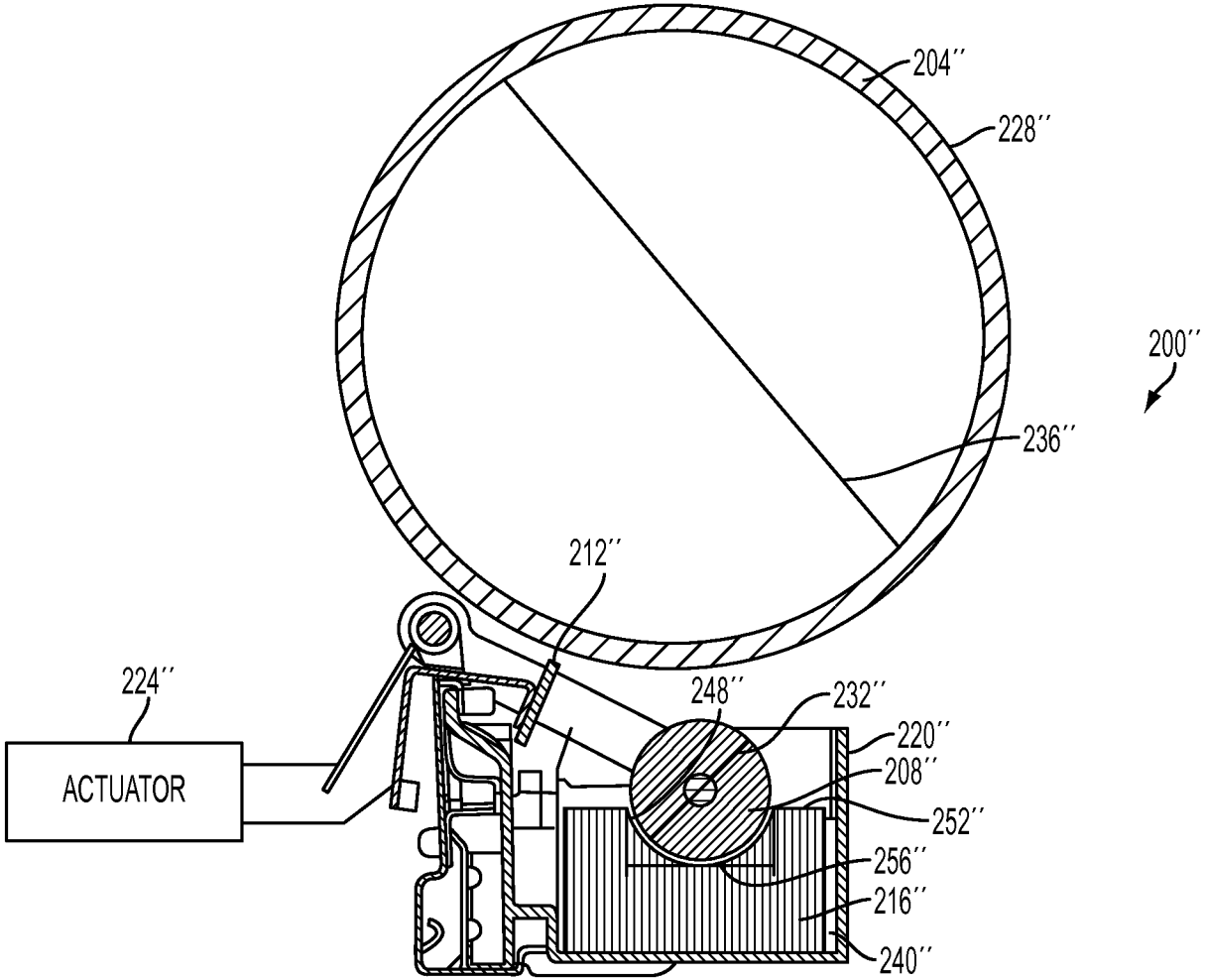
FIG. 4 depicts another alternative release agent application system having a release agent pad with a depression in its top surface.
Figure 5:
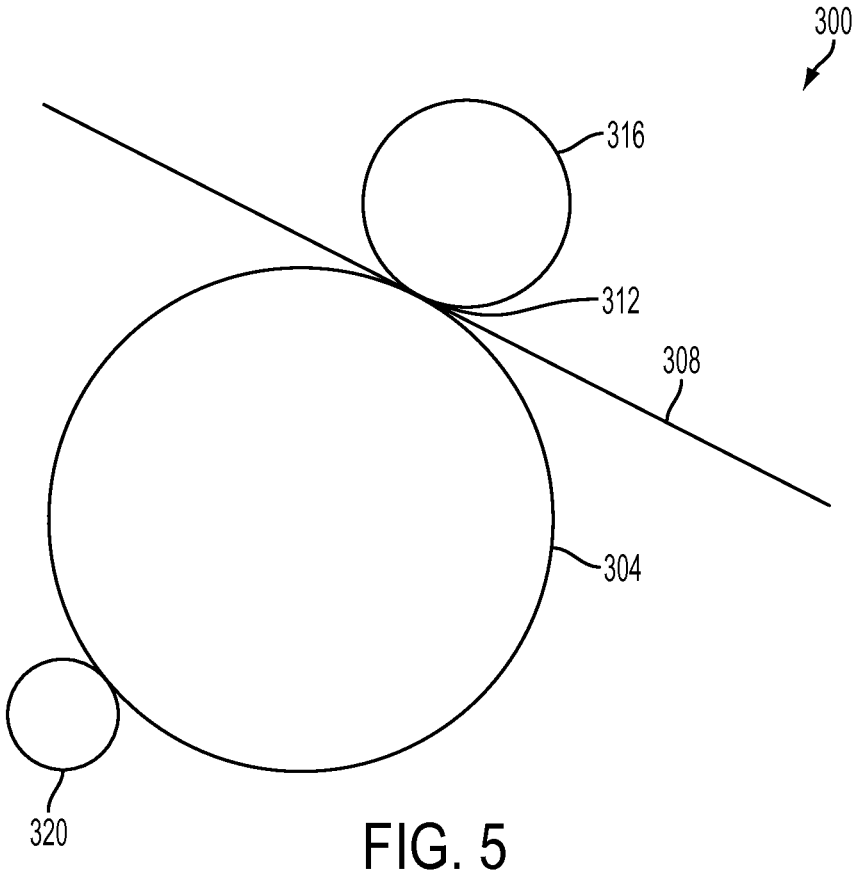
FIG. 5 depicts a typical indirect printer capable of utilizing one of the release agent application systems depicted in FIG. 1, 2, 3 or 4.
Figure 6:
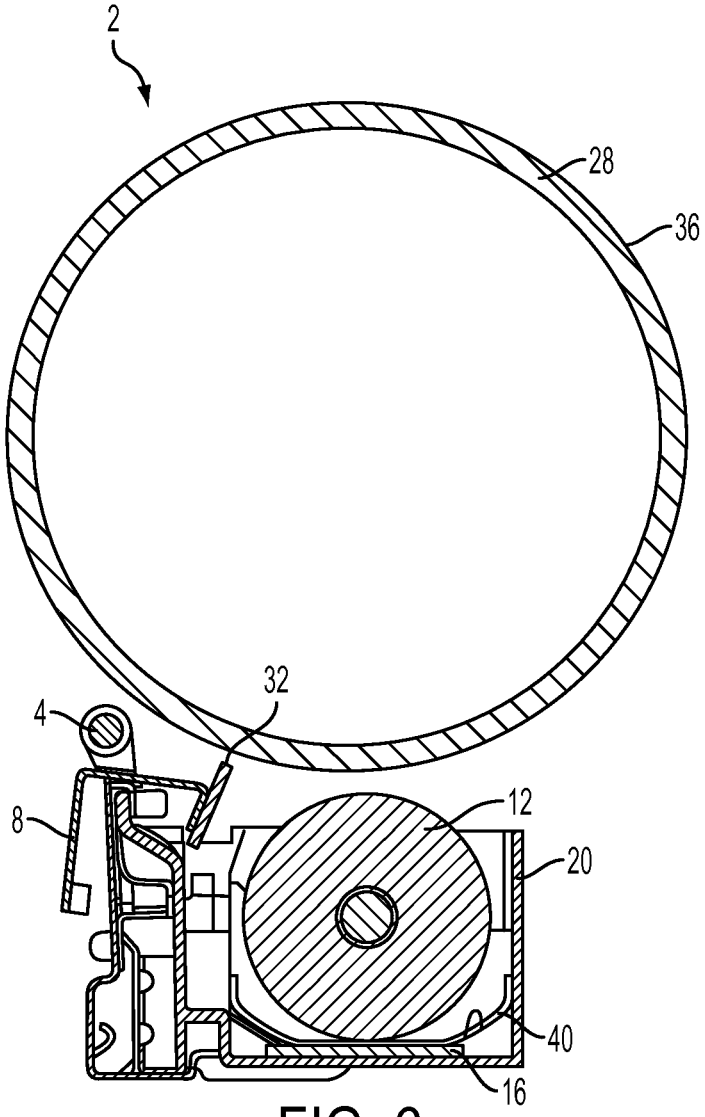
FIG. 6 depicts a typical release agent application system that utilizes a release agent applicator roller within a tray in the indirect printer.

In another alternative embodiment, shown in FIG. 4, release agent application system 200" includes a release agent pad 216". The release agent application system 200" is arranged and operated in substantially the same way as release agent application system 200' described above and shown in FIG. 3. Release agent application system 200" differs from release agent application system 200' because the release agent pad 216" includes a depression 248" formed in the top surface 252".

The depression 248" is curved and shaped complementarily to the release agent applicator roller 208" so that the top surface 252" can receive the release agent applicator roller 208". In one embodiment, the depression 248" has a width 256" that is slightly larger than the diameter 232" of the release agent applicator roller 208" so that approximately half of the release agent applicator roller 208" can be received by the release agent pad 216". In another embodiment, the width 256" of the depression 248" need not be sized to receive approximately half of the release agent applicator roller 208", but is curved and shaped complementarily to the release agent applicator roller 208" so that the top surface 252" can receive the release agent applicator roller 208". Because the release agent pad 216" includes the depression 248", the pad accommodates the cylindrical tube of the release agent applicator roller 208" enabling more contact surface area between the release agent pad 216" and the release agent applicator roller 208". The increased contact surface area enables faster transfer of release agent from the release agent pad 216" to the release agent applicator roller 208".

In one embodiment, the release agent applicator roller 208" is configured such that it is accommodated within the release agent pad 216" to reduce the amount of space that the release agent application system 200" requires within the printer as these elements are able to be arranged closer together. In another embodiment, the amount of space that the release agent application system 200" requires is maintained, and a larger release agent pad 216" is accommodated within the space. In this embodiment, a greater amount of release agent is able to be stored in a system of the same size.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A release agent application system for use in a solid ink printer comprising:

an image receiving member;

a receptacle having a bottom and side walls that are configured to hold a volume;

a pad positioned on the bottom of the receptacle within the volume of the receptacle, the pad being configured to store a supply of release agent;

a roller positioned within the receptacle, the roller being configured to absorb release agent from the pad in response to the roller being in contact with the pad; and an actuator operatively connected to the roller, the actuator being configured to move the roller between a first position, in which the roller contacts the pad and is a first distance from the bottom of the receptacle, and a second position, which is at a second distance from the bottom of the receptacle, the second distance being greater than the first distance and at which the roller contacts the image receiving member and does not contact the pad.

2. The release agent application system of claim 1 further comprising:

a metering blade positioned proximate the image receiving member and the roller, the metering blade being configured to move between a first position, in which the metering blade is out of contact with the image receiving member, and a second position, in which the metering blade contacts the image receiving member to remove excess release agent.

3. The release agent application system of claim 2 wherein the receptacle is positioned to enable release agent removed from the image receiving member by the metering blade to enter the volume of the receptacle.

4. The release agent application system of claim 3 further comprising:

a filter positioned in the receptacle, the filter being configured to remove particulates from the release agent removed from the imaging member by the metering blade before the release agent is absorbed by the pad.

5. The release agent application system of claim 1 wherein the roller is a cylinder made of foam material.

6. The release agent application system of claim 1 wherein the roller is a cylindrical tube made of porous material that surrounds a volumetric space.

7. The release agent application system of claim 1 wherein the pad has a curved portion that is complementary to a diameter of the roller.

8. A solid ink printer comprising:

an image receiving member;

a release agent applicator system configured to apply release agent to a surface of the image receiving member, the release agent applicator system including:

a receptacle having a bottom and side walls that are configured to hold a volume;

a pad positioned on the bottom of the receptacle within the volume of the receptacle, the pad being configured to store a supply of release agent;

a roller positioned within the receptacle, the roller being configured to absorb release agent from the pad in response to the roller being in contact with the pad;

an actuator operatively connected to the roller, the actuator being configured to move the roller between a first position, in which the roller contacts the pad and is a first distance from the bottom of the receptacle, and a second position, which is at a second distance from the bottom of the receptacle, the second distance being greater than the first distance and at which the roller contacts the image receiving member and does not contact the pad; and a printhead configured to apply ink onto the release agent on the surface of the image receiving member.

9. The solid ink printer of claim 8 further comprising:

a metering blade positioned proximate the image receiving member and the roller, the metering blade being configured to move between a first position, in which the metering blade is out of contact with the image receiving member, and a second position, in which the metering blade contacts the image receiving member to remove excess release agent.

10. The solid ink printer of claim 9 wherein the receptacle is positioned to enable release agent removed from the image receiving member by the metering blade to enter the volume of the receptacle.

11. The solid ink printer of claim 10 further comprising:

a filter positioned in the receptacle, the filter being configured to remove particulates from the release agent removed from the imaging member by the metering blade before the release agent is absorbed by the pad.

12. The solid ink printer of claim 8 wherein the roller is a cylinder made of foam material.

13. The solid ink printer of claim 8 wherein the roller is a cylindrical tube made of porous material that surrounds a volumetric space.

14. The solid ink printer of claim 8 wherein the pad has a curved portion that is complementary to a diameter of the roller.

* * * * *